United States Patent [19]

DeVries et al.

[11] Patent Number: 5,022,784

[45] Date of Patent: Jun. 11, 1991

[54] UNDERTOW REDUCTION SYSTEM FOR SHORELINE PROTECTION

[75] Inventors: Jack DeVries, Oxnard; James A. Bailard, Carpinteria, both of Calif.; Daniel M. Hanes, Gainesville, Fla.

[73] Assignee: The United States of America as represented by the Secretary of the Navy, Washington, D.C.

[21] Appl. No.: 583,742

[22] Filed: Sep. 17, 1990

[51] Int. Cl.[5] ..... E02B 3/04

[52] U.S. Cl. ..... 405/15; 405/74

[58] Field of Search ..... 405/15, 21, 22, 26, 405/30, 52, 73, 74, 80

[56] References Cited

U.S. PATENT DOCUMENTS 4,645,377 2/1987 Vesterby ..... 405/74

4,898,495 2/1990 Lin ..... 405/73

*Primary Examiner*—David H. Corbin

*Attorney, Agent, or Firm*—Ron Billi

[57] ABSTRACT

An apparatus and method for reducing the strength of the nearbottom offshore directed current inside the surfzone thereby promoting and sand accretion on the beach. An arrangement of pipes is placed in the surfzone and operates to sequester a portion of surfzone fluid. The sequestered surfzone fluid is conveyed out to sea by way of the piping system thereby reducing the velocity and quantity of surfzone fluid reducing sand erosion.

10 Claims, 1 Drawing Sheet

UNDERTOW REDUCTION SYSTEM FOR SHORELINE PROTECTION

BACKGROUND OF THE INVENTION

This invention relates to a method for artificially reducing the strength of the nearbottom offshore directed current inside the surfzone thereby promoting sand accretion on the beach.

Beach erosion is a significant problem throughout the industrialized world. Although there can be a variety of causes, beach erosion can often be traced back to the construction of dams and flood control structures which cut off the natural supply of sand to the beach. This results in a gradual reduction of beach width, first manifesting itself near the mouth of the affected river or stream, and slowly spreading down coast. Eventually beaches become so narrow that winter storm waves begin to directly threaten beachfront structures.

Traditional beach erosion solutions have included seawalls, groin fields, offshore breakwaters and artificial beach nourishment. With the exception of seawalls, these solutions act to widen the beach, either by increasing the sand supply (beach nourishment), or slowing the rate of longshore sand transport (groins and offshore breakwaters). Seawalls simply shield the shoreward property from wave action, while doing nothing to address the ongoing beach erosion problem. In addition, all of these approaches are expensive and time consuming to construct.

The present invention seeks to limit beach erosion by altering the nearbottom velocity field within the surfzone thereby promoting onshore sand transport and widening the beach.

SUMMARY OF THE INVENTION

Accordingly, it is the object of the present invention to provide a method and apparatus for promoting sand accretion on the beach by utilizing a piping system in the surfzone that reduces the nearbottom or "undertow" current and thereby promote sand accretion on the beach.

More specifically, the method and apparatus of the present invention includes a plurality of parallel intake pipes located in the surfzone and positioned and arranged to capture a portion of the incoming and outgoing surfzone fluid in such a way that the sequestered surfzone fluid returns by way of the piping system, thereby reducing the quantity and velocity of surfzone fluid returning by normal means (i.e. outside the pipes) and lessening the migration of sand to the sea.

"Wave setup", as shown in FIG. 1, is the difference in elevation between the time-averaged water level, in the presence of waves, and the still water level. Under natural conditions, the wave setup contributes to the formation of a vertical circulation pattern inside the surfzone. Above the wave troughs, there is an onshore flow of water associated with the wave bores. Beneath the wave troughs, there is a corresponding return flow of water termed the "undertow". Increasing the height of the incident waves causes a corresponding increase in the strength of the undertow. The wave setup is the driving force which propels sequestered water through the undertow reduction system to be discharged offshore. Laboratory experiments have shown that if water is extracted from the inner portion of the surfzone there is a corresponding decrease in the undertow strength. This phenomena, which forms the basis for the undertow reduction system, has an important consequence on the cross-shore sediment transport.

The transport of sediment in the cross-shore direction is governed by a dynamic balance between the wave velocity asymmetry, the undertow and the downslope component of gravity. The wave velocity asymmetry accounts for the more intense onshore motion under a wave crest, and tends to move sediment onshore. Both the undertow and the downslope component of gravity act to move sediment offshore. Under small wave conditions, the wave velocity asymmetry dominates and the beach accretes. Under large wave conditions, the undertow dominates and the beach erodes. Accordingly, the purpose of the undertow reduction system is to reduce the undertow, increasing the tendency towards onshore sand movement. Over time, this causes a net increase in the width of the natural beach.

DETAILED DESCRIPTION OF THE PREFERRED EMBODIMENT

Figure 1:
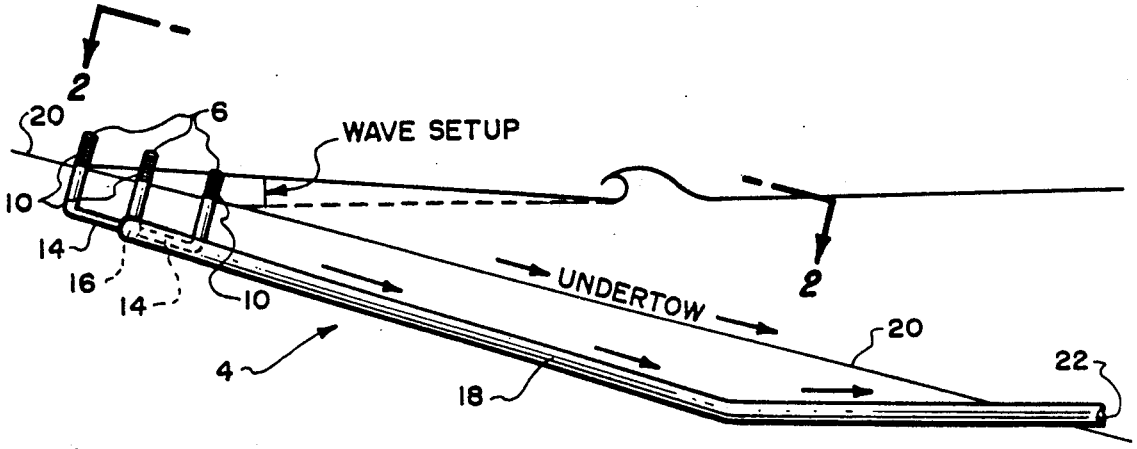
FIG. 1 is a cross sectional view of the present invention showing the present invention located in the surfzone.
Figure 2:
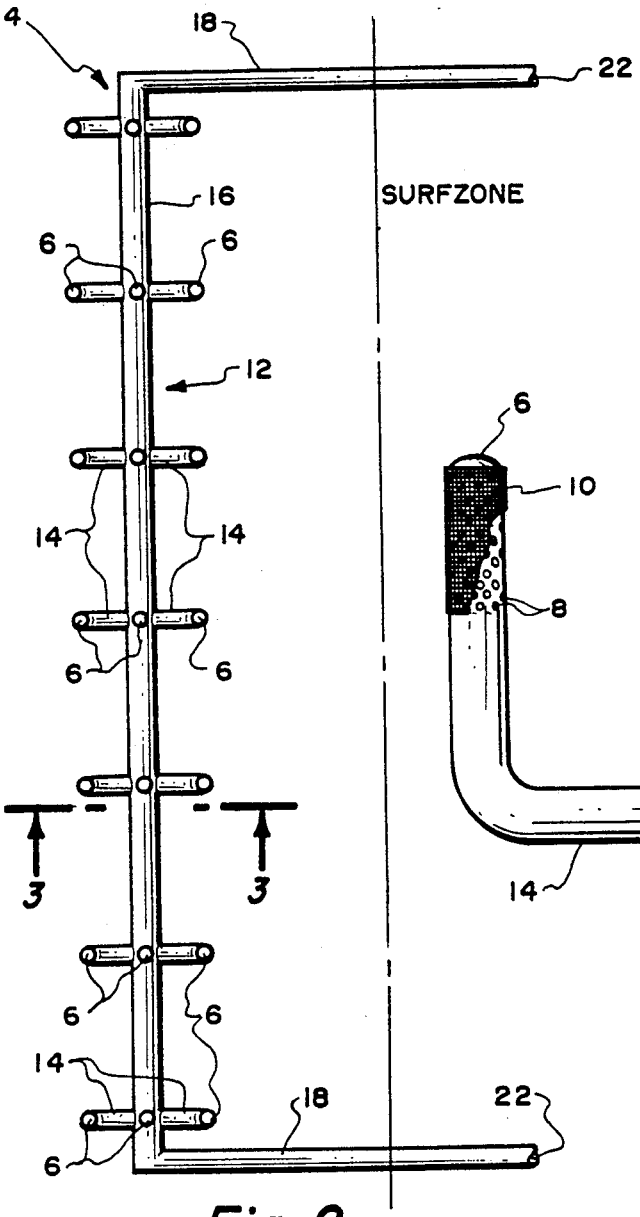
FIG. 2 is a top view taken along line 2—2 of FIG. 1 of the present invention showing the intake pipes, manifold and discharge pipes located in the surfzone.

As shown in FIGS. 1 and 2, undertow reduction system 4 is located in the surfzone and includes a plurality of parallel intake pipes 6, manifold 12 and discharge pipes 18. Manifold 12 includes a plurality of arms 14 and manifold span 16. Intake pipes 6 are attached substantially perpendicular to arms 14 so that when manifold 12 is in position in the surfzone, perforations or openings 8 (see FIG. 3) in intake pipes 6 will extend above sand surface 20. In this way, intake pipes 6 may receive the undulating surfzone fluid in the surfzone and act as a conduit for first conveying water flow to manifold 12 and then to discharge pipes 18 for final delivery to open water offshore. Water flow in the undertow reduction system is naturally driven by the wave setup (see FIG. 1) which is produced by the shoreward flux of wave-driven momentum. The greater the wave setup, the greater the hydraulic head available to propel sequestered water through undertow reduction system 4 and offshore through outfalls 22. It should be noted that openings 8 may be covered by screening means 10, shown in FIG. 3 for preventing sand and other debris from entering undertow reduction system 4. Screening means 10 may be of any conventional type such as a wire mesh or gravel filled bag. In the preferred embodiment, screening means 10, consists of wire mesh with 50 micron openings wrapped around intake pipes 6 and secured by wire (not shown).

Figure 3:
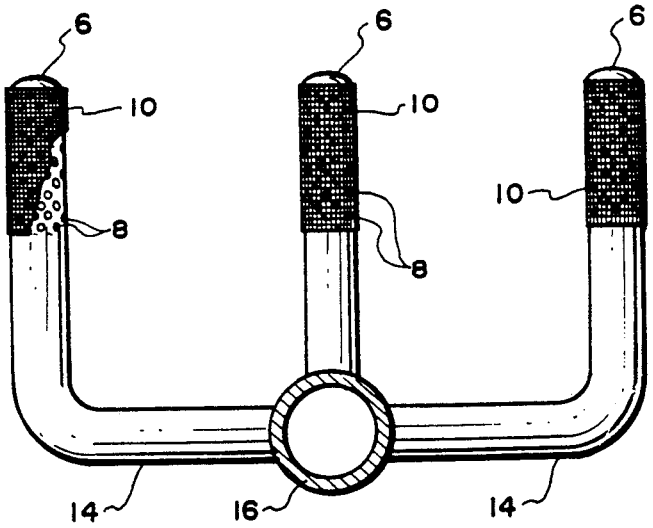
FIG. 3 is a detailed cross sectional view taken along section 3—3 of FIG. 2 showing the intake pipes, openings, screening material, manifold arms and manifold span.

Intake pipes 6 are arranged in groups of 3 at each location of arms 14; arms 14 being spaced, approximately 60 inches apart along the length of manifold 12, substantially as shown in FIGS. 1, 2 and 3. All conduit inside dimensions are sized to produce minimal head-losses on the order for example of approximately 0.65 feet.

In the preferred embodiment, intake pipes 6 are approximately 4 inches in inside diameter and approximately 48 inches long and extend approximately 18 inches above sand surface 20 when in operation. It should be noted that intake pipes 6 must extend sufficiently above sand surface 20 to minimize fouling by sand and debris but must also be capable to receive water in the surfzone.

Approximately 125 openings 8, are randomly provided in intake pipe 6. Each opening or perforation is approximately ½ inch in diameter and extends from the outer surface of intake pipe 6 to the inner surface of intake pipe 6 thereby allowing water to flow from the surfzone to the inner regions of undertow reduction system 4.

Manifold span 16 is approximately 14 inches in inside diameter and approximately 60 feet long between discharge pipes 18. Manifold arms 14 are approximately 4 inches in inside diameter and approximately 60 inches long. Discharge pipes 18 are approximately 24 inches in inside diameter and approximately 150 feet long, the length dependent on the beach characteristics such as cross-shore location of the breakpoint and beach slope. The undertow reduction system may be fabricated from PVC pipe, stainless steel or other suitable material. It should be noted that the size and placement of the undertow reduction system may vary substantially depending on the amount of surfzone fluid desired to be sequestered, the amount of beach desired to be protected, the beach characteristics, and the strength of the surfzone fluid. The preferred embodiment was designed for a beach with a slope of 1/50 and a significant wave height of 3 feet.

Placement of the intake pipes 6 should be in the inner surfzone approximately at the still water line for high tide. Manifold span 16, manifold arms 14, and discharge pipes 18 are buried approximately 30 inches below sand surface 20. Outfall 22 is located approximately at the breakpoint of the design waves.

Obviously many modifications and variations of the present invention are possible in the light of the above teachings. It is therefore to be understood that within the scope of the appended claims, the invention may be practiced otherwise than as specifically described.

What is claimed is:

1. An apparatus for artificially reducing the strength of the nearbottom offshore directed current inside a surfzone thereby promoting sand accretion on a beach comprising:

(a) means located in the surfzone for sequestering a portion of surfzone fluid;

(b) discharge openings located beyond said surfzone for allowing the discharge of the sequestered surfzone fluid to open sea; and (c) conveying means communicating with the sequestering means on one end and with the discharge openings on the other end, the conveying means operating to guide said sequestered surfzone fluid from said sequestering means to said discharge openings.

2. The apparatus described in claim 1, wherein said sequestering means comprises a plurality of intake pipes arranged and configured to communicate with said surfzone fluid, said intake pipes allowing said surfzone fluid to enter said intake pipes and be conveyed then discharged into the open sea.

3. The apparatus described in claim 2, wherein each of said intake pipes includes a plurality of perforations, said perforations extending from the outer surface of said intake pipes to the inner surface of said intake pipes whereby said surfzone fluid may enter said intake pipes through said perforations.

4. The apparatus described in claim 3, wherein said perforations are randomly spaced around said intake pipes.

5. The apparatus described in claim 4, further comprising means for screening whereby only water, substantially free of sand and other debris, is permitted to enter said perforations.

6. The apparatus described in claim 5, wherein said intake pipes are substantially parallel and arranged in groups of 3, each said group spaced substantially the same distance apart from said adjacent group.

7. The apparatus described in claim 6, wherein said conveying means further comprises a manifold and discharge pipes.

8. The apparatus described in claim 7, wherein said manifold further comprises manifold arms and a manifold span each manifold arm communicating on one end with a single said sequestering means and on the other end with the manifold span and wherein each end of said manifold span communicates with one said discharge pipe and wherein said sequestering means, said manifold arms, said manifold span and said discharge pipes provide a conduit for said sequestered surfzone fluid to return to open sea driven naturally by the wave setup.

9. A method for artificially reducing the strength of the nearbottom offshore directed current inside a surfzone thereby promoting sand accretion on the beach, said method comprising:

(a) sequestering a portion of surfzone fluid inside the surfzone; then (b) conveying the sequestered surfzone fluid to a discharge point beyond said surfzone; then (c) discharging said sequestered surfzone fluid into the open sea at the discharge point.

10. The method described in claim 9, wherein said method further comprises screening said surfzone fluid whereby only water, substantially free of sand and other debris, is sequestered.

* * * * *